US005778583A

United States Patent [19]

Larsen

[11] Patent Number: 5,778,583

[45] Date of Patent: Jul. 14, 1998

[54] STRETCHABLE MARKING ARTICLE

[75] Inventor: Brian D. Larsen, Worthington, Minn.

[73] Assignee: Bedford Industries, Inc., Worthington, Minn.

[21] Appl. No.: 672,958

[22] Filed: Jul. 1, 1996

[51] Int. Cl.[6] ..... G09F 23/00

[52] U.S. Cl. ..... 40/637; 40/665

[58] Field of Search ..... 40/637, 665, 662

[56] References Cited

U.S. PATENT DOCUMENTS

| | | | |
|---|---|---|---|
| 1,337,722 | 4/1920 | Porter | 40/665 |
| 1,397,079 | 11/1921 | Cohen | 40/665 |
| 2,669,047 | 2/1954 | Rieger | 40/637 |
| 3,251,149 | 5/1966 | Wing | 40/299 |
| 5,318,817 | 6/1994 | Ohno et al. | 40/6 |

FOREIGN PATENT DOCUMENTS

| | | | |
|---|---|---|---|
| 1068220 | 6/1954 | France | 40/665 |

*Primary Examiner*—Cassandra H. Davis

*Attorney, Agent, or Firm*—R. C. Baker & Associates, Ltd.

[57] ABSTRACT

The new stretchable marking article permits simultaneous banding and tagging of merchandise and has an elastomeric band for banding about merchandise and a tag comprised of an information portion for displaying printed matter and an attachment portion for bonding to the information portion after encircling a section of the elastomeric band to form a channel for stretching movement of the band. The tag is formed of plastic sheet material and the channel for stretching movement of the band has a length less than the width of the information portion. A composite article of manufacture comprises a plurality of the stretchable marking articles on a carrier, with all information portions of the stretchable marking article in an alignment for easy hand removal of discrete marking articles from the alignment.

15 Claims, 2 Drawing Sheets

STRETCHABLE MARKING ARTICLE

BACKGROUND OF THE INVENTION

This invention relates to a stretchable merchandise marking article carrying a non-stretchable tag, and more particularly to a stretchable marking article having a tag for printed matter securely attached to an endless elastomeric band for banding merchandise.

Elastomeric bands, commonly called rubber bands, are easily stretched about the mouth of a bag or about multiple boxes, or about merchandise itself, such as about a grouping of agricultural produce or about a single item of merchandise (e.g., a rolled or folded newspaper).

Elastomeric bands are, however, not suitable for direct printing of a Universal Produce Code (UPC bar code) thereon because stretching of the elastomeric band about merchandise stretches a bar code printed thereon and distorts the width of the bars and the spacing therebetween. Such distortion can make the bar code unreadable or produce a false scanner reading.

Nevertheless, in modern mass merchandising outlets such as superstores or supermarkets, there has been an almost complete movement toward labeling products (or the packaging thereof) with an identification code, such as a UPC bar code readable by an optical scanner.

In the particular case of agricultural produce, additional printed markings beyond a bar code are generally desired. Such additional markings include a "Product Look Up" (PLU) number identification code, a trademark of the producer, possibly a collective or certification mark, storage directions, serving suggestions, recipes for preparing the particular produce, a table of "Nutritional Facts," and an indication of the place of origin (e.g., country or state).

One of the most efficient environments for performing the tasks of banding and tagging agricultural produce with appropriate printed marking information is in the agricultural field as the produce is harvested (or soon thereafter or at least prior to any significant processing of the produce). For example, a field worker, with a supply of elastomeric bands in a looped condition about his or her forearm, grasps a clump of produce with the hand of the band-carrying forearm, and with the other hand moves a band from the band-carrying forearm over the wrist and hand of that arm and then about the clump of produce. The band is then released and the band contracts about the produce. What remains to be done is the step of fixing a tag on the produce.

It would be desirable to fix the elastomeric band and tag on the produce in a single step, but there are problems in doing so. The problem is dramatically illustrated by the different characteristics required for the band as compared to the marking tag. The elastomeric band has to be stretchable, whereas the tag for carrying reliable markings for scanning has to be non-stretchable or non-elastomeric. It is difficult to form a secure and reliable bond between the two diverse components.

One solution to the problem has been that of punching a hole in a plastic tag and tediously inserting a loop of an elastomeric band through the hole and threading the rest of the band through the inserted loop. The approach gives operable results but is labor-intensive and not easily automated.

Nevertheless, a secure attachment between an elastomeric band and a plastic sheet material tag is critical to withstand the processing operations to which banded and tagged agricultural produce is subjected after being harvested and banded and tagged in the field. Produce banded and tagged in the field is subjected to washing operations such as high-velocity water blasts, chilling operations including that of dumping ice on the tagged produce, and even submersion of the produce in chilling water and thrashing it about by conveyors. Such processing operations can easily destroy weak attachments or connections between elastomeric bands and plastic tags containing critical marking material.

This invention solves the problem by providing a sturdy, reliable attachment between an elastomeric band and a non-elastomeric tag in a manner adaptable to automated production and gives a new product that can withstand the severe processing treatment expected for freshly harvested agricultural produce that has been elastomerically banded and non-elastomerically tagged.

SUMMARY OF THE INVENTION

The invention provides a stretchable merchandise marking article carrying a non-stretchable optically scannable code. The article consists essentially of an endless elastomeric band and a non-elastomeric tag. An inherent characteristic of the elastomeric band is that it has a circumferential longitudinal direction for stretching about merchandise to band the merchandise. The non-elastomeric tag component consists of a single continuous panel of flexible, water-resistant plastic sheet material discrete from the elastomeric band. The tag has an information portion carrying printed matter and an attachment portion for bonding to the information portion. The attachment portion is folded over an elongate section of the circumferential longitudinal dimension of the elastomeric band and bonded to the information portion at a location spaced from the fold so that the plastic sheet material encircles the elongate section of the band and forms a channel within which the encircled elongate section of the band is movably lodged. A significant key requirement of the invention is that the information portion of the sheet material has an area size greater than the area size of the attachment portion so that at least a part of both opposing surfaces of the information portion can be viewed for any printed matter thereon, including the printed matter of an optically scannable code. Another critical feature of the invention is that the information portion has a width adjacent the channel for the band greater than the length of that channel. Thus, the information portion extends outward beyond the length of the channel for the band. Still further, the channel for the band has a length no greater than half the circumferential longitudinal dimension of the elastomeric band and not greater than about 2.5 centimeters or 1 inch. This maximum length is required to prevent bending forces exerted on the channel during stretching and flexing of the section of the elastomeric band within the channel in use applications from being significantly transmitted to the information portion. In other words, the channel length has to be minimal so as to permit only minimal transmission to the information portion of bending forces during stretching and flexure of the elastomeric band in use applications. The minimal bending of the information portion is insufficient to cause interference with optical scanning of the optically scannable code on the information portion.

The invention also provides, as a new article of manufacture, an assembly of a plurality of the stretchable merchandise banding and tagging articles carrying a non-stretchable optically scannable code. In this assembly, the tag component of each article is in alignment for easy gripping and removal of one discrete banding and tagging article at a time from the assembly.

Still other benefits and advantages of the invention will be evident as this description proceeds.

DESCRIPTION OF THE PREFERRED EMBODIMENT

Figure 1:
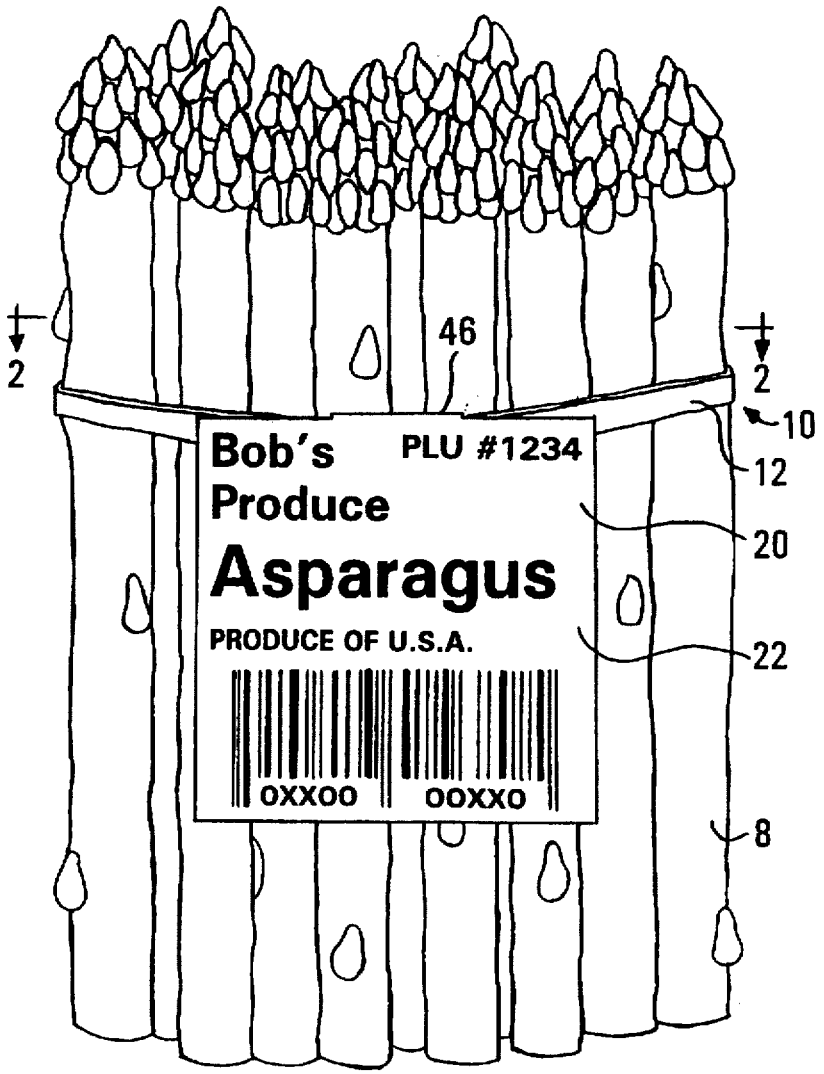
FIG. 1 is a schematic front view of the new stretchable merchandise marking article with the elastomeric band thereof in a banded condition about a clump of vegetables, namely asparagus, and shows illustrative marking information on the front of the information portion of the tag.
Figure 2:
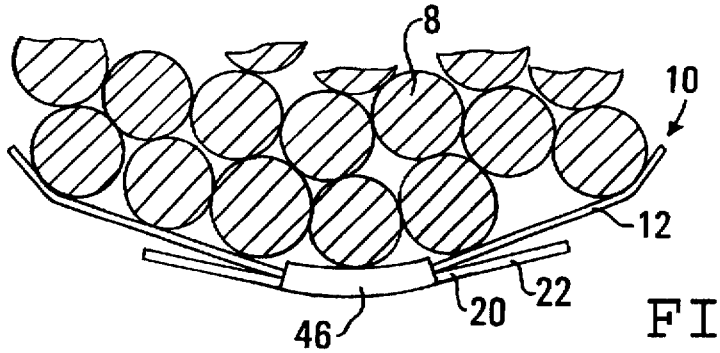
FIG. 2 is a schematic cross-sectional view taken on line 2—2 of FIG. 1, with parts broken away, and particularly illustrates the relationship between the information portion of the tag and the portion of the tag folded and forming a channel about the elastomeric band.

Referring to the drawing, the new stretchable marking article 10 of the invention is illustrated on a clump of asparagus 8. The new article consists of two components, namely an endless elastomeric band 12 and a non-elastomeric tag 20 consisting of a single continuous panel of flexible, water-resistant plastic material having an information portion 22 and an attachment portion 34. The two components are held together by a bond between parts of the tag 20, namely a bond 50 (see FIG. 4) between the attachment portion 34 and information portion 22 of the tag component. The sheet material of the tag 20 effectively is folded at a line or edge 46 so as to encircle an elongated segment or section of the elastomeric band 12 and is bonded to itself to form a channel 48 (see FIG. 4) within which the segment is movable for performance of its elasticity. Nevertheless, the channel prevents the removal of the elastomeric band from its attachment to the sheet material of the tag.

The endless nature of the elastomeric band 12 is such that it extends in a continuous ring or loop defining a circumferential longitudinal dimension, and this dimension is capable of stretching or elongation to increase the observable size of the circumference of the band. Useful elastomeric bands for the invention may be made out of natural or synthetic rubber or equivalent material. A key feature of elastomeric or rubber bands is that they can be significantly stretched and nevertheless quickly return to their original condition after stretching forces are removed. Useful sizes for elastomeric bands of the invention range between a diameter of about ¾ inch (about 2 cm) up to a diameter of about 6 inches (about 15 cm) in the unstretched or unextended condition. Thus, the range for the circumferential longitudinal dimension may vary from approximately 2.5 inches (approximately 6.5 cm) to approximately 19 inches (approximately 48 cm). Rubber bands or elastomeric bands outside the range of diameter or circumferential longitudinal dimension just specified are impractical for use in practicing the invention. Indeed, bands widely used have an upper limit of diameter not over about 4 inches (about 10 cm). Bands of 4-inch diameter have a circumferential longitudinal dimension or loop length of about 12.5 inches (about 32 cm).

Most rubber or elastomeric bands of sufficient strength for clumping produce have cross sections of at least 1/32 inch (0.08 cm) in each perpendicular direction, and generally at least about 1/16 inch (about 0.16 cm) in each perpendicular direction. They may have an even greater dimension in one or both perpendicular directions. However, bands of cross-sectional dimension greater than about 1/8 inch (above 0.32 cm) in both perpendicular directions are, for the most part, unnecessarily strong and therefore needlessly expensive. Elastomeric bands having cross sections of about 1/16 inch in one direction and 1/8 inch in the perpendicular direction are especially useful. Indeed, bands having a size of about 1/8 inch in one direction and up to about ¼ inch (about 0.64 cm) in a perpendicular direction are quite satisfactory for practicing the invention. While typically the rubber bands for practicing the invention will be square or rectangular in cross section, it is conceivable that oval or circular cross-sectional elastomeric bands of equivalent cross-sectional size may be employed if desired. Bands of uniform cross section throughout their circumferential longitudinal dimension are preferred for the invention.

Bands of larger cross section such as those having a cross-sectional dimension of ½ inch or more in one direction are not only unnecessarily expensive, but are generally unsatisfactory because of their extreme width and the problem that extreme width creates in use applications and in attaching a tag of sheet material to the band in accordance with the invention.

The tag 20 for the invention is formed from a continuous panel of plastic (i.e., organic synthetic) sheet material. Suitable sheet material is relatively thin (e.g., generally not over about 15 thousands of an inch or mils in thickness) and is flexible and pliable but is non-elastomeric. It cannot easily be stretched to any significant extent to disrupt bar codes by a simple hand-applied force. Thus, the sheet material has the dimensional stability to carry a reliable (i.e., non-distorted) print of a scannable UPC code as well as other markings.

The sheet material for the tag also has to be water resistant in that it does not disintegrate and does not significantly pucker or wrinkle or otherwise disfigure or deform when placed in water. In fact, not only the sheet material but also the printing on it, and especially any scannable product identification matter on it, should be sufficiently water resistant to avoid disintegration or destruction when repeatedly subjected to water and washing operations.

The sheet material for the tag also has to be tough in the sense of being tear resistant. It has to withstand the tension of an elastomeric band pulling and rubbing against it (e.g., against the fold 46 of the attachment portion).

Useful materials for forming the plastic sheet material of the tag include polyolefinic thermoplastics, polyesters, and others that exhibit the critical properties discussed. Polymers of ethylene, propylene, styrene, as well as a variety of other monomers and mixtures of monomers (e.g., to make co-polymers and ter-polymers, etc.) can be used. Sheet thickness for polyester plastics can be quite thin, even down to the 3 or 4 mil range, and still exhibit the toughness and the non-elastomeric character required. The polymers may be formulated so that printing is readily accepted on the surface of the sheet material or treated with special surface treatments to effect acceptance of printing. The exact structure and composition of suitable plastic sheet material for practicing the invention may vary. One preferred sheet material for the tag is commercially available under the trademark "Teslin" from PPG Industries of Pittsburgh, Pa. It is a polyolefin thermoplastic printable much the same as paper. Any of a variety of commercially available water-insoluble inks compatible or accepted on a plastic sheet and retained thereon, and in any desired color, may be used to print the markings and details on the information portion of the tag. This technology is readily understood in the art. (If it should be desired to use water-soluble ink markings, a thin film of water-insoluble plastic may be applied over them to create the needed water resistance.)

The attachment structure of the invention gives a secure and reliable connection despite the significant difference in the material of the band and tag components. The attachment structure permits the band to be freely stretched without restriction by the sheet material of the tag (or by any bond between parts of the tag). Further, the independent formation and manufacture of the band and tag components prior to attachment together permits the particular physical dimensions of the tag and the band to be easily changed and, as a result, easily mixed and matched into many different combinations of band and tag sizes.

Figure 3:
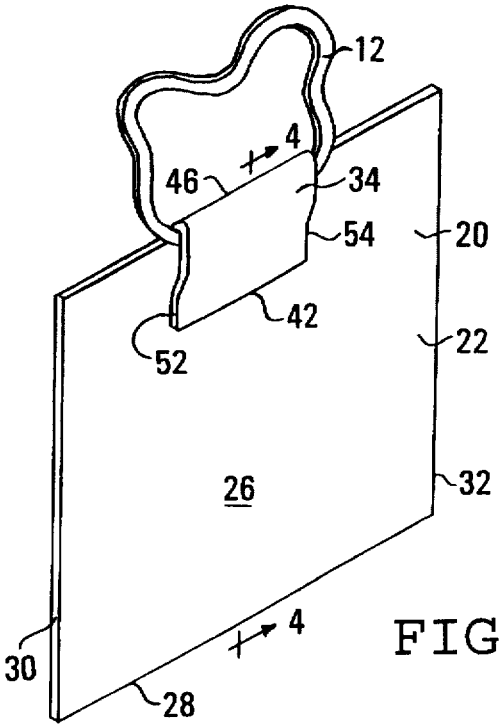
FIG. 3 is a schematic perspective view of the new article showing the attachment portion and the relationship of the elastomeric band to the entire tag portion.
Figure 4:
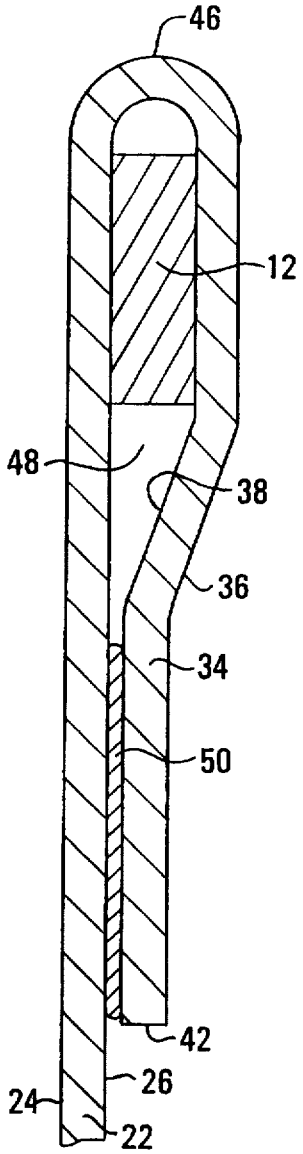
FIG. 4 is a schematic sectional view of the new article (with a portion of the information portion of the tag broken away) taken along line 3—3 of FIG. 3 and particularly illustrates the attachment relationship of the tag to the elastomeric band.

In forming the stretchable marking article of the invention, the sheet material of the tag is folded or turned over upon itself along a fold 46 as illustrated in FIGS. 3 and 4. The fold 46 can be looked upon as a line or boundary between the information 22 or banner portion of the tag and the attachment or tab portion 34 of the tag. The information portion and attachment portion extend in substantially the same direction from the fold and are in substantially parallel orientation. The sheet material forming the information portion has opposing front 24 and rear 26 surfaces and the sheet material of the attachment portion 34 also has opposing front 36 and rear 38 surfaces. The rear surfaces 26, 38 are bonded together to form a channel 48 (see FIG. 4) for a section or segment of the circumferential longitudinal dimension of the elastomeric band. (The section of the band within the channel is hidden by the attachment portion 34 in FIG. 3 and other figures.) The attachment portion 34 is folded over an elongate section of the elastomeric band and then bonded to the information portion at a location 50 spaced from the fold 46. This then causes the sheet material to completely encircle an elongate section or segment of the band and form a channel 48 for the encircled section. But the encircled section of the band 12 is movable in the channel (e.g., for stretching) even though it is lodged in the channel. The connection firmly holds the band and tag together but permits relative movement between the two components.

The bond 50 of the inner or rear surface 38 of the attachment tab to the rear surface 26 of the information banner lies along a strip area near the transverse free outer edge 42 of the attachment tab most remote from the fold 46. The bond 50 extends in a direction substantially parallel to the fold 46 but spaced from it. Preferably the bond extends from one side edge 52 of the attachment tab 34 to the other side edge 54 (see FIG. 3). The width of the strip area occupied by the bond 50 (measured perpendicular to the direction of the fold 46) is at least as great as about half the greatest transverse direction (i.e., greatest width) of the elastomeric band 12 and minimally is at least 1/32 inch (at least 0.08 cm). The width need not and should not exceed about three times the greatest transverse dimension of the elastomeric band. Excessively wide strips of bond detract from the display area of the information portion. Preferably the width of the bond 50 does not exceed about twice the greatest transverse direction of the band 12.

The bond 50 is critically formed directly between the rear surface 26 of the information portion and the rear or inner surface 38 of the attachment portion. No elastomeric band material is interposed between the bonded surfaces to interfere with a strong bond. In other words, no elastomeric band structure interrupts the continuousness of the bond 50 between the information banner and the attachment tab.

The bond 50 is suitably formed by adhesively securing the parts together, although fusion without the addition of adhesive may be employed where the tag material is susceptible for fusion (as by heat). A variety of known bonding adhesives and known surface treatments to enhance adhesion may be used. A useful approach is to employ adhesive formulations that can be cured (e.g, cross-linked or polymerized) in situ by using ultraviolet light. The benefit of such an approach is that it can save one from removing volatile solvents from an adhesive coating, but solvent-based adhesives may be employed, if desired. Aggressively tacky pressure-sensitive adhesives of the type employed for bonding automobile license tags to license plates may be used. Hot melt adhesives present another approach that avoids the need for solvent removal, and polyurethane hot melt adhesives, especially those that are moisture curable, are illustrative of those useful for uniting polyester films. Ethylene vinyl acetate adhesives can also be useful for bonding. Water-borne curable adhesives present another possible approach. Any of a variety of other strong adhesives known to adhesive technicians may be used.

The length of the attachment tab from the fold 46 to its outer free edge 42 (i.e., measured perpendicularly from the fold) should not be greater than about four or five times the greatest transverse or cross-sectional width of the band, and generally will not exceed about three times the greatest width of the encircled section of the band. The minimum length of the attachment tab is at least about twice the greatest transverse (cross-sectional) width of the band. The relatively short length for the attachment tab contributes to maximum display area for printed matter on both sides of the information portion 22.

A critical feature is the limited width of the attachment tab from one side 52 to the other 54 (i.e., measured in a direction parallel to the fold). This width normally will be uniform throughout the length of the tab and will determine the length of the channel 48 for the encircled elongated section of the circumferential longitudinal dimension of the band. Both are not greater than about half the circumferential longitudinal dimension of the band and both are never greater than about 2.5 cm or 1 inch. This maximum dimension of 2.5 cm for the width of the attachment tab 34 as well as for the length of the channel 48 prevents the bending forces exerted on the channel, by stretching and flexing of the section of the band within the channel during use applications, from causing a sufficient bending of the information portion 22 to interfere with optical scanning of the UPC code on the information portion. The minimal length of the channel, and minimal width for the attachment tab, is 1 cm (about 2/5 inch), although 1.5 cm (generally about 1/2 inch) is more preferred from a strength standpoint as a minimum. Relatively narrow tabs have the advantage (as compared to wider tabs) of having decreased frictional resistance to stretching of the band, in part because the longitudinal extent of the band section encircled by the sleeve or channel is reduced. Further, the narrower tab width permits the band to bend away from the tab so that the curve of the band circumscribing more rounded merchandise (e.g., small clumps) is not imposed on most of the information portion, and is only imposed on a relatively narrow width of the information portion, which makes information on the surfaces of the information banner easier to read and scan.

Plastic tag material is important to provide the tear resistance needed. Plastic also contributes to a relatively neat appearance in the supermarket display case after having been exposed to vigorous produce processing operations.

The width of the information portion or banner from one side edge 30 to the other 32 (i.e., measured parallel to the fold 46) may vary at different distances from the fold, but is most preferably uniform throughout the length of the banner from the fold 46. The width of the banner in portions proximate to or adjacent to the channel is at least greater than the length of the channel, and may be several times the length of the channel. Tags of the greatest practical utility generally will have information banners greater in width than about 1 inch (about 2.5 cm), and usually greater in width than about 2 inches (about 5 cm) up to about 4 inches (about 10 cm).

The furthest extent or length of the information banner from the fold 46 to its free outer edge 28 must be at least equal to and preferably is significantly greater than the furthest extent or length of the attachment tab 42 away from the fold. Usually, the length dimension of the information part (e.g., the distance between the fold 46 and the free edge 28) will be at least about 150% or 200% greater than the length dimension of the attachment tab. This relationship between the lengths of the information and attachment tab portions permits at least a part of both the front and the rear surfaces of the information portion to bear printed matter that is viewable and not obstructed by the tab. Most preferably, the length of the information banner is at least about two times greater than the length of the attachment tab, and may be even greater. Information portion or banner lengths from about 1 inch (2.5 cm) up to about 6 inches (15 cm) are the most useful.

The front and rear surfaces of the information banner 20 can have a multitude of informational markings on them. For agricultural produce, these markings should include a scannable product code or identification. UPC bar codes are the most popular and are fully effective to provide scannable product identification matter. Other information markings are Product look-up (PLU) numbers, a trademark identification, serving suggestions, storage suggestions, nutrition facts, country of origin, etc. If desired, the outer surface of the attachment tab may have graphics printed thereon.

An illustrative article of the invention can have an elastomeric band that measures about 12 cm (about 5 inches) in circumferential longitudinal dimension and about 0.15 cm by 0.30 cm (about 1/16 inch by about 1/8 inch) in cross section. The tag component can have an information portion about 6.5 cm (approximately 2.5 inches) in both width and length. Its attachment tab can have a length of about 1.3 cm (approximately 0.5 inch) and a width of also about 2.5 cm.

Figure 5:
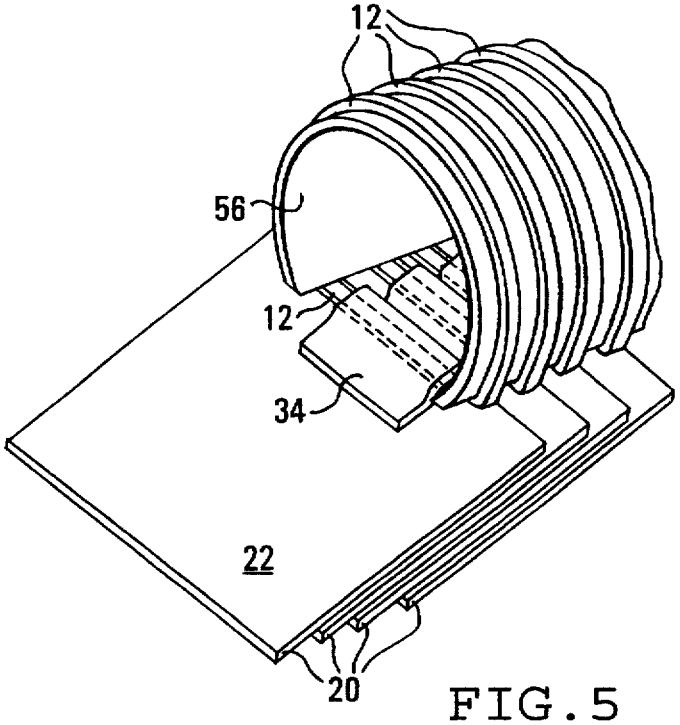
FIG. 5 is a schematic perspective view of a new article of manufacture having a plurality of the new stretchable merchandise marking articles oriented with the information portion of the tags in aligned relationship for easy hand removal of individual articles from the alignment.

As illustrated in FIG. 5, the invention includes an assembly of the new stretchable marking articles 10 in a composite article of manufacture for dispensing individual articles from the assembly. The assembly suitably comprises an elongated carrier 56, which may take the form of a tube or sleeve but also may take the form of a sheet member that is curved into a U-shape. The elastomeric band 12 of each article is looped to extend about the elongated carrier, and all tag components 20 of the stretchable marking articles in the assembly are in an alignment and each extends outwardly at the same (or substantially the same) uniform angle from the elongated carrier. The angle may vary depending on the relationship between the circumferential length of the band and the cross-sectional size of the outer surface of the carrier. Thus, each tag of each of the stretchable marking articles is uniformly lapped with others in the alignment and yet is readily available for quick gripping by a field worker and pulling to separate the gripped article from all other articles in the alignment. The worker may place a carrier (in the form of a sleeve or U-shape) upon his or her forearm and use it as a holder or dispenser from which the worker may remove individual stretchable marking articles from the alignment and fix them on clumps of produce. But the worker also may, if desired, place all of the stretchable marking articles on his/her forearm by simply transferring them from the elongated carrier to his/her forearm while maintaining the alignment of the non-elastomeric tags of the composite assembly. In either event, a single stretchable marking article in the alignment is easily gripped at its non-elastomeric tag by a worker for removal of a discrete marking article from the alignment by the worker's free hand. Simultaneously, the elastomeric band of the removed marking article is fixed about a clump of produce in the same manner that the worker has employed an elastomeric band for clumping merchandise in the past. FIG. 5 additionally can serve as an illustration of a technique for holding an elastomeric band 12 in position while the attachment tab portion 34 of a tag 20 is folded over a section of the band and then sealed to the information portion 22 of the tag.

Those skilled in the art will readily recognize that this invention may be embodied in still other specific forms than illustrated without departing from the spirit or essential characteristics of it. Therefore, the scope of the invention is indicated by the appended claims rather than the foregoing description, and all variations that come within the meaning and range of equivalency of the claims are therefore intended to be embraced thereby.

That which is claimed is:

1. A stretchable merchandise marking article carrying a non-stretchable optically scannable code, said article consisting essentially of an endless elastomeric band having a circumferential longitudinal dimension for stretching about merchandise to band said merchandise, and a non-elastomeric tag consisting of a single continuous panel of flexible water resistant plastic sheet material discrete from said elastomeric band and having an information portion for displaying printed matter thereon and an attachment portion for bonding to said information portion, said information portion and said attachment portion being on opposites sides of a fold line and each said portion having a length extending perpendicularly from said fold line, said length of said information portion from said fold line being substantially greater than said length of said attachment portion from said fold line, said attachment portion being folded at said fold line over an elongate section of the longitudinal dimension of said elastomeric band and bonded to said information portion at a location spaced from said fold line so that said sheet material encircles said elongate section of said band and forms a channel having a length within which said encircled elongate section of said band is firmly but movably lodged, said length of said channel being no greater than half the circumferential longitudinal dimension of said elastomeric band and not greater than about 1 inch, said information portion of said sheet material having an area size substantially greater than the area size of said attachment portion such that a substantial majority of both opposing surface areas of said information portion can be viewed for any printed matter thereon, said printed matter carried on said information portion including said optically scannable code, said information portion further having a width adjacent said channel greater than said length of said channel so as to cause part of said information portion to extend outward beyond said length of said channel, whereby bending forces exerted on said channel during stretching and flexing of said section of said elastomeric band within said channel in use applications are only minimally transmitted to said information portion and do not cause sufficient bending of said information portion to interfere with optical scanning of said optically scannable code on said information portion.

2. The article of claim 1 wherein said bond comprises an adhesive.

3. The article of claim 1 wherein said bond comprises a strip extending parallel to said channel, said strip being at least about 1/16 inch wide.

4. The article of claim 1 wherein said elastomeric band has a circumferential longitudinal dimension between about 1 inch and 19 inches.

5. The article of claim 1 wherein said information portion has a width greater than twice the length of said channel.

6. The article of claim 1 wherein said attachment portion has a width greater than about 2/5 inch.

7. A plurality of articles satisfying the requirements of claim 1 combined with an elongated carrier about which the elastomeric bands of said articles are looped, said tags of said articles being aligned with each other to form an alignment of tags always having an endmost tag, each said endmost tag of said alignment being available for easy hand grasping and pulling to dislodge the elastomeric band thereof from its looped condition about said carrier.

8. The combination of claim 7 wherein said carrier has a hollow interior adapted to receive the forearm of a person such that the forearm extends through the elastomeric bands looped about said carrier.

9. The combination of claim 7 wherein the tag of each said article of said alignment is lapped over an adjacent tag in said alignment to give an elongated compact arrangement for said marking articles of said alignment.

10. As a new article of manufacture: The article of claim 1 in an assembly comprising a plurality of stretchable merchandise marking articles, each marking article of said assembly satisfying the requirements of claim 1, said assembly having the non-elastomeric tag of each marking article in said assembly in an alignment always having an outermost marking article, thereby to allow a user to hand grip any said outermost marking article of said alignment by its tag for removal of each successive outermost marking article from said assembly.

11. As a new article of manufacture: a plurality of individual stretchable merchandise marking articles carrying a non-stretchable optically scannable code, said marking articles each consisting essentially of an endless elastomeric band having a circumferential longitudinal dimension for stretching about merchandise to band the merchandise, and a non-elastomeric tag consisting of a single continuous panel of flexible water-resistant plastic sheet material discrete from said elastomeric band and having an information portion for displaying printed matter thereon and an attachment portion for bonding to said information portion, said attachment portion being folded over an elongate section of the longitudinal dimension of said elastomeric band and bonded to said information portion at a location spaced from said fold so that said sheet material encircles said elongate section of said band and forms a channel having a length within which said encircled elongate section of said band is movably lodged, said information portion of said sheet material having an area size greater than the area size of said attachment portion such that at least a part of both opposing surfaces of said information portion can be viewed for any printed matter thereon, said printed matter carried on said information portion including said optically scannable code, said information portion having a width adjacent said channel greater than said length of said channel, thereby to cause part of said information portion to extend outward beyond said length of said channel, and said length of said channel being no greater than half the circumferential longitudinal dimension of said elastomeric band and not greater than about 1 inch such that bending forces exerted on said channel during stretching and flexing said section of said elastomeric band within said channel in use applications are only minimally transmitted to said information portion and do not cause sufficient bending of said information portion to interfere with optical scanning of said optically scannable code on said information portion, said plurality of marking articles being combined with an elongated carrier about which the elastomeric bands of said marking articles are looped, said tags of said marking articles being aligned with each other to form an alignment of tags always having an endmost tag, each said endmost tag in said alignment being available for easy hand grasping and pulling to dislodge the elastomeric band thereof from its looped condition about said carrier.

12. The combination of claim 11 wherein said carrier has a hollow interior adapted to receive the forearm of a person such that the forearm extends through the elastomeric bands looped about said carrier.

13. The combination of claim 11 wherein the tag of each said article of said alignment is lapped over an adjacent tag in said alignment to give an elongated compact arrangement for said marking articles of said alignment.

14. As a new article of manufacture: an assembly comprising a plurality of stretchable merchandise marking articles carrying a non-stretchable optically scannable code, each said marking article consisting essentially of an endless elastomeric band having a circumferential longitudinal dimension for stretching about merchandise to band the merchandise, and a non-elastomeric tag consisting of a single continuous panel of flexible water-resistant plastic sheet material discrete from said elastomeric band and having an information portion for displaying printed matter thereon and an attachment portion for bonding to said information portion, said attachment portion being folded over an elongate section of the longitudinal dimension of said elastomeric band and bonded to said information portion at a location spaced from said fold so that said sheet material encircles said elongate section of said band and forms a channel having a length within which said encircled elongate section of said band is movably lodged, said information portion of said sheet material having an area size greater than the area size of said attachment portion such that at least a part of both opposing surfaces of said information portion can be viewed for any printed matter thereon, said printed matter carried on said information portion including said optically scannable code, said information portion having a width adjacent said channel greater than said length of said channel, thereby to cause part of said information portion to extend outward beyond said length of said channel, and said length of said channel being no greater than half the circumferential longitudinal dimension of said elastomeric band and not greater than about 1 inch such that bending forces exerted on said channel during stretching and flexing said section of said elastomeric band within said channel in use applications are only minimally transmitted to said information portion and do not cause sufficient bending of said information portion to interfere with optical scanning of said optically scannable code on said information portion, said assembly having the non-elastomeric tag of each marking article in said assembly in an alignment always having an outermost marking article, thereby to allow a user to hand grip any said outermost marking article of said alignment by its tag for removal of each successive outermost marking article from said assembly.

15. A stretchable merchandise marking article carrying a non-stretchable optically scannable code, said article consisting essentially of an endless elastomeric band having a circumferential longitudinal dimension for stretching about merchandise to band said merchandise, and a non-elastomeric tag consisting of a single continuous panel of flexible water resistant plastic sheet material discrete from said elastomeric band and having an information portion for displaying printed matter thereon and an attachment portion for bonding to said information portion, said information portion and said attachment portion being on opposites sides of a fold line and each said portion having a length extending perpendicularly from said fold line, said length of said information portion having a length from said fold line substantially greater than the length of said attachment portion from said fold line, said attachment portion being folded at said fold line over an elongated section of the longitudinal dimension of said elastomeric band and bonded to said information portion at a location spaced from said fold line so that said sheet material encircles said elongate section of said band and forms a channel having a length within which said encircled elongate section of said band is firmly but movably lodged, said information portion of said sheet material having an area size greater than the area size of said attachment portion such that at least a part of both opposing surfaces of said information portion can be viewed for any printed matter thereon, said printed matter carried on said information portion including said optically scannable code, said information portion further having a width adjacent said channel greater than said length of said channel, thereby to cause part of said information portion to extend outward beyond said length of said channel, and said channel having a length such that bending forces exerted on said channel during stretching and flexing said section of said elastomeric band within said channel in use applications are only minimally transmitted to said information portion and do not cause sufficient bending of said information portion to interfere with optical scanning of said optically scannable code on said information portion.

* * * * *